United States Patent [19]

Baker

[11] Patent Number: 4,997,558

[45] Date of Patent: Mar. 5, 1991

[54] SUCTION CONTROL FILTER SYSTEM FOR SWIMMING POOLS

[76] Inventor: William H. Baker, 30 Honeysuckle Woods, Clover, S.C. 29710

[21] Appl. No.: 214,694

[22] Filed: Jul. 1, 1988

[51] Int. Cl.[5] ..... E04H 3/20

[52] U.S. Cl. ..... 210/143; 210/169; 210/278; 210/279; 210/416.2; 4/510

[58] Field of Search ..... 210/169, 275, 277, 278, 210/279, 456, 291, 416.2, 143; 4/510, 512

[56] References Cited

U.S. PATENT DOCUMENTS

| | | | |
|---|---|---|---|
| 883,467 | 3/1908 | Mitchell | 210/169 |
| 3,061,100 | 10/1962 | Fehlmann | 210/169 |
| 3,616,468 | 11/1971 | Takacs | 210/169 |
| 3,668,712 | 6/1972 | Baker | 4/510 |
| 3,668,714 | 6/1972 | Baker | 210/169 |
| 3,815,160 | 6/1974 | Baker | 210/169 |
| 4,059,856 | 11/1977 | Patterson | 4/172.17 |
| 4,127,485 | 11/1978 | Baker et al. | 210/169 |

*Primary Examiner*—W. Gary Jones
*Assistant Examiner*—Matthew O. Savage

[57] ABSTRACT

A suction control filter system for swimming pools is provided, in which the vacuum filter of the water recirculation system features positive suction backwash of the filter during cleaning.

29 Claims, 9 Drawing Sheets

SUCTION CONTROL FILTER SYSTEM FOR SWIMMING POOLS

Most swimming pools built today include a perimeter gutter and a water recirculation system taking water both from the gutter and directly from the pool, filtering it, at a location remote from the pool, such as a filter house, and then recycling the filtered water to the pool, using an extensive network of buried interconnected piping. The water recirculation system when the pool is quiescent may draw a skimming flow off the top of the pool through one or a plurality of skimming weirs or skimming gutter, and also a bottom flow directly from the pool via the main drain. Both flows are combined, pumped through a filter bed, and then returned to the pool, if desired after the addition of bactericides such as halogen. When the pool is active, in addition to any skimming flow considerable amounts of water from the pool may also splash over into the gutter, and this water also is returned via the water recirculation system to the pool, after having passed through the filter. The piping network leads to considerable pressure drop through the recirculation system, and maintenance problems.

This system represents a considerable improvement over the early filter systems, in which a diatomite or cartridge skim filter was placed at the side of the pool, and quickly led to the eclipse of such poolside systems. They required frequent cleaning or filter replacement because of low capacity, and have not been marketed for many years.

The pump in the water recirculation system for recirculating the water through the filter bed and back to the pool is normally placed between the pool drain and/or gutter drain and the filter bed, so that dirty water is forced under pressure through the filter. This of course requires a filter tank built to withstand relatively high internal fluid pressures, and as the filter bed becomes burdened with contaminants, the upstream fluid pressure can increase. The necessity of housing the filter bed in a pressure tank of course increases the cost of the filter system.

Cleaning of the filter bed is normally accomplished by a reverse flow or backwash flow of water through the bed, unloading the contaminants, and carrying them off with the backwash flow. For the purpose, backwash pumps, elevated storage tanks, or other devices have been required, to supply the backwash water, and cause it to flow through the bed in the reverse direction, either by gravity or by positive pump pressure applied to the downstream side of the bed. Either way, the contaminants are unloaded from the upstream surface of the bed (now downstream during backwash flow) chiefly by the force of the backwash flow.

Filter systems in which the water is drawn through the bed by a slight vacuum drawn on the downstream side of the bed, by placing the water recirculation pump downstream of the filter rather than upstream, have been known for a long time, but only in recent years have they become universally accepted for use in swimming pools. Mitchell Ser. No. 883,467 dated Mar. 31, 1908 shows such a system. Similar systems are shown in U.S. Pat. Nos. 3,061,100 to Fehlmann dated Oct. 30, 1962 and 3,616,468 to Takacs dated Nov. 2, 1971. In both Mitchell and Takacs the water travels through the bed by gravity, and is drawn out through the pump, whence it is pumped back to the pool. Fehlmann shows a similar system, and in addition the pump is reversible, and can reverse the flow of water through the bed, so as to unload the contaminants by backwashing flow. However, these systems are unable to apply suction on the contaminant-loaded surface of the bed during backwash.

While the principles of construction of a filter tank for use with swimming pools have been appreciated for a considerable time, it has not been easy to design a filter that does not pose problems in use. Swimming pool water can be highly corrosive, and unless the surfaces of the equipment contacting it are corrosion-resistant, or coated so as to prevent corrosion, the life of the component can be rather short. This is particularly true of filter tanks, which are normally made of metal. While stainless steel can be used, it is rather expensive, and to minimize costs the choice is normally a coated metal material, but coatings can wear, or flake, or chip, so that the metal surface must be susceptible of being inspected from time to time, to make sure that it is properly protected. It is also necessary of course to change the filter bed from time to time, and to service component parts such as valves, and this requires ease of access.

It is desirable that the filter be relatively simple to operate, with a minimum of wearable parts and parts that can go out of order, so as to avoid the need for taking the filter out of service for inspection and repair. Nowadays, it is also necessary that the filtered water be of the very highest standard, since the sanitary and health codes laid down by the governmental authorities are becoming more and more stringent, and ever more difficult to meet.

U.S. Pat. No. 4,127,485, patented Nov. 28, 1978, to Baker and Wall, provides a vacuum filter for vacuum flow filtration through a filter bed of water from a swimming pool comprising an open-top tank; a filter bed of particulate material in the tank; fluid flow connections communicating the tank with a water recirculation system for the swimming pool, one adjacent an upper portion and one adjacent a lower portion of the filter bed; an inlet line communicating the swimming pool with the tank and maintaining the level of water in the tank at a level corresponding to a level of water in the swimming pool, thereby providing a head of water for gravity backwash flow through the filter bed, and valves controlling flow into the tank via the fluid flow connections, between the tank and the inlet line, and between the tank and the water recirculation system; and a direct fluid flow connection communicating a gutter drain of the swimming pool with the tank; a vacuum is drawn downstream of the filter bed by a pump recirculating filtered water to the swimming pool.

A feature of the invention is the separate entry into the filter chamber or compartment of the tank of both main drain flow from the swimming pool and gutter flow from the perimeter gutter system of the swimming pool. A water level in the filter compartment is maintained via the main drain flow by virtue of the pressure head in the swimming pool, for the purpose of gravity backwash flow. This pressure head can be provided either by feeding main drain flow into an antechamber before the filter compartment of the tank, or by feeding main drain flow directly into the filter compartment of the tank, as shown in the embodiments of the invention illustrated in the drawings.

This head of pressure also makes possible regulation of the proportionate volume of flow entering the filter chamber from the main drain and from the gutter. In effect, increasing gutter flow throttles back main drain flow from the swimming pool, in proportion to the increase in gutter flow.

This is because flow from the gutter into the filter compartment increases the water level in the filter compartment above the normal water level maintained under the pressure head from the swimming pool via the main drain. An increase in level in the filter compartment has a throttling effect on flow through the main drain into the compartment, slowing down main drain flow, since such flow now encounters the increased pressure head in the filter compartment. As gutter flow increases, so does the pressure head in the compartment, and the throttling of the main drain flow also increases in proportion.

This throttling effect is intended to ensure that there will be a sufficient capacity reserved in the water recirculation system upstream of the vacuum filter to accommodate any increased gutter flow that may be encountered, so as to prevent flooding of the gutters. The vacuum filter provides such accommodation to increased gutter flow by throttling back main drain flow, in proportion to pressure head in the filter compartment.

Gravity backwash flow is normally adequate for cleaning the upstream filter bed surface of most contaminants, but it is not sufficient when the contaminants are sticky, or heavy, enough to resist unloading. In such cases, suction at the upstream contaminant-loaded surface would be desirable but no available filter system has the capability to achieve this.

In accordance with the present invention, a vacuum filter is provided that is capable of providing suction or vacuum backwash flow as well as vacuum or suction forward flow. This is made possible by incorporating means to provide reduced pressure in the filter compartment at the upstream surface of the filter bed and maintain the reduced pressure there, so that backwash flow passing through the filter bed in the reverse direction passes into a filter compartment maintained at said reduced pressure; and is drawn off from the filter compartment as suction flow. Said reduced pressure can be obtained by means for closing off the filter compartment and for applying suction from the water recirculating pump of the filter system, for example, to the closed filter compartment.

During backwash, unloading of contaminants collected on the upstream filter surface proceeds under the backwash flow, aided by the suction thus applied to the filter surface, greatly increasing cleaning effectiveness.

The invention accordingly provides a water cleaning and recirculation system for swimming pools comprising, in combination:

(1) a vacuum filter receiving water from the swimming pool;

(2) a water recirculation system receiving water from the filter and returning it to the pool;

(3) the water recirculation system including a pump drawing a vacuum downstream of the vacuum filter and recirculating filtered water to the swimming pool;

(a) the vacuum filter including a filter tank; a filter bed of particulate material in the tank having upstream and downstream filter surfaces with respect to normal filtering water flow through the filter bed, with backwash flow in the reverse direction; a first inlet communicating the swimming pool with the tank above the upstream filter surface for gravity flow into the tank and maintaining a predetermined level of water in the tank in relation to a level of water in the swimming pool; a second inlet communicating the tank with the swimming pool adjacent the perimeter thereof for gravity flow into the tank above the upstream filter surface; and an outlet communicating the tank with the water recirculation system for suction flow of filtered water from the tank to the swimming pool;

(b) closure means closing off the second inlet to provide a reduced below-normal fluid pressure in the tank above the upstream filter surface;

(c) a fluid flow connection from the tank above the upstream filter surface to the upstream side of the pump for drawing a suction vacuum above the upstream filter surface;

(d) an inlet in fluid flow connection with the downstream side of the filter bed for water feed in reverse or backwash flow through the filter bed for cleaning contaminants collected on the upstream filter surface;

whereby suction forward flow through the filter bed is provided in normal filtering operation and suction reverse flow through the filter bed is provided in normal backwash filter bed cleaning operation.

The invention further provides a swimming pool comprising side walls and a bottom adapted to retain water therewithin, and a water cleaning and recirculation control system in fluid flow connection therewith comprising, in combination:

(1) a vacuum filter;

(2) the water recirculation system including a pump drawing a vacuum downstream of the filter and recirculating filtered water to the swimming pool;

(a) the vacuum filter including a filter tank; a filter bed of particulate material in the tank having upstream and downstream filter surfaces with respect to normal filtering water flow through the filter bed, with backwash flow in the reverse direction; a first inlet communicating the swimming pool with the tank above the upstream filter surface for gravity flow into the tank and maintaining a predetermined level of water in the tank in relation to a level of water in the swimming pool; a second inlet communicating the tank with the swimming pool adjacent the perimeter thereof for gravity flow into the tank above the upstream filter surface; and an outlet communicating the tank with the water recirculation system for suction flow of filtered water from the tank to the swimming pool;

(b) closure means closing off the second inlet to provide a reduced below-normal fluid pressure in the tank above the upstream filter surface;

(c) a fluid flow connection from the tank above the upstream filter surface to the upstream side of the pump for drawing a suction vacuum above the upstream filter surface;

(d) an inlet in fluid flow connection with the downstream side of the filter bed for water feed in reverse or backwash flow through the filter bed for cleaning contaminants collected on the upstream filter surface;

whereby suction forward flow through the filter bed is provided in normal filtering operation and suction reverse flow through the filter bed is provided in normal backwash filter bed cleaning operation.

The vacuum filter in accordance with the invention comprises:

(a) a tank;

(b) a filter bed of particulate material in the tank having upstream and downstream filter surfaces with respect both to normal filtering water flow through the filter bed and to backwash flow in the reverse direction;

(c) a first inlet for communicating the swimming pool with the tank above the upstream filter surface for gravity flow into the tank and maintaining a predetermined level of water in the tank in relation to a level of water in the swimming pool;

(d) a second inlet for communicating the tank with the swimming pool adjacent the perimeter thereof for gravity flow into the tank above the upstream filter surface;

(e) a first outlet for communicating the tank with a pump in a water recirculation system for suction flow of filtered water from the tank and to the swimming pool;

(f) a closure means for closing off the second inlet during reverse or backwash flow and providing a closed space in the tank at the upstream filter surface for maintaining a reduced below-normal fluid pressure in that space;

(g) a second outlet for fluid flow connection from the tank above the upstream filter surface to the upstream side of a pump for drawing a reduced below-normal fluid pressure in that space at the upstream filter surface; and (h) a third inlet in fluid flow connection with the downstream side of the filter bed for water feed in reverse or backwash flow through the filter bed for cleaning and carrying off contaminants collected on the upstream filter surface.

In the above embodiments, the second inlet connection with the swimming pool can for example be with a perimeter gutter, or a skimmer, or both.

This vacuum filter is of an extremely simple design, and utilizes suction flow for backwash flow of the water through the filter bed, the backwash flow being drawn via the main drain from the pool. Since the filtration is under atmospheric pressure, while a vacuum is drawn downstream of the filter bed by the water recirculation pump, it is not necessary to use a heavy closed pressure vessel for the filter tank. Since backwashing is by suction flow, a through pressure flow of the water throughout the bed is ensured, making it possible to backwash the bed completely in all portions. The water that is used is the water from the swimming pool, which can be replenished without difficulty in the normal way from the make-up supply.

Because the pressure downstream of the surface of the filter bed in both directions of flow through the filter bed while the pump is withdrawing the flow downstream of the bed is below atmospheric, the water flows evenly through the bed in either direction, under laminar flow conditions, so that there is no possibility of short-circuiting through the bed, with contaminant breakthrough. High differential pressure across the bed cannot build up, even when the bed is heavily loaded with contaminants. Contamination of the effluent water due to breakthrough the bed is eliminated, because of the low differential pressure. True flow streamlines are formed within the bed, giving a contact/adsorption system, ensuring complete removal of suspended particles from the incoming water. Since no parts of the system are under any pressure greater than atmospheric, the system is simple, safe and reliable. Moreover, exposure of the water after filtration to a pressure below atmospheric allows gases normally dissolved in the water to escape from solution. These collect below the filter bed, but the discharge of the collected gases can easily be accomplished by stopping the flow through the bed from time to time, thus permitting the gases to percolate upwardly in reverse flow direction through the bed without encountering a counterflow of water, and to escape into the atmosphere from the surface of the water. Since the filter can be contained within an open tank, there is easy and complete access to any component part at all times.

The closure means can take the form of a valve in the first inlet communicating the swimming pool with the tank, and at the tank top or side of the tank, closing the filter compartment above the filter bed surface, so that a vacuum can be drawn within the filter compartment during backwash. The valve can be a slide valve or a plug valve, operated manually or automatically (illustrated in the drawings), an umbrella valve, or a poppet valve. The valve can be closed automatically when the backwash cycle is begun and suction drawn by the pump.

The interposition of a suction plate with a slide or plug valve closing off an aperture of the plate communicating with the filter compartment, as shown in the drawings, makes it possible to close off the filter compartment with only one valve instead of two or more.

Preferred embodiments of the water cleaning and recirculation system utilizing a poolside or remote vacuum filter in accordance with the invention are shown in the drawings, in which.

Figure 1:
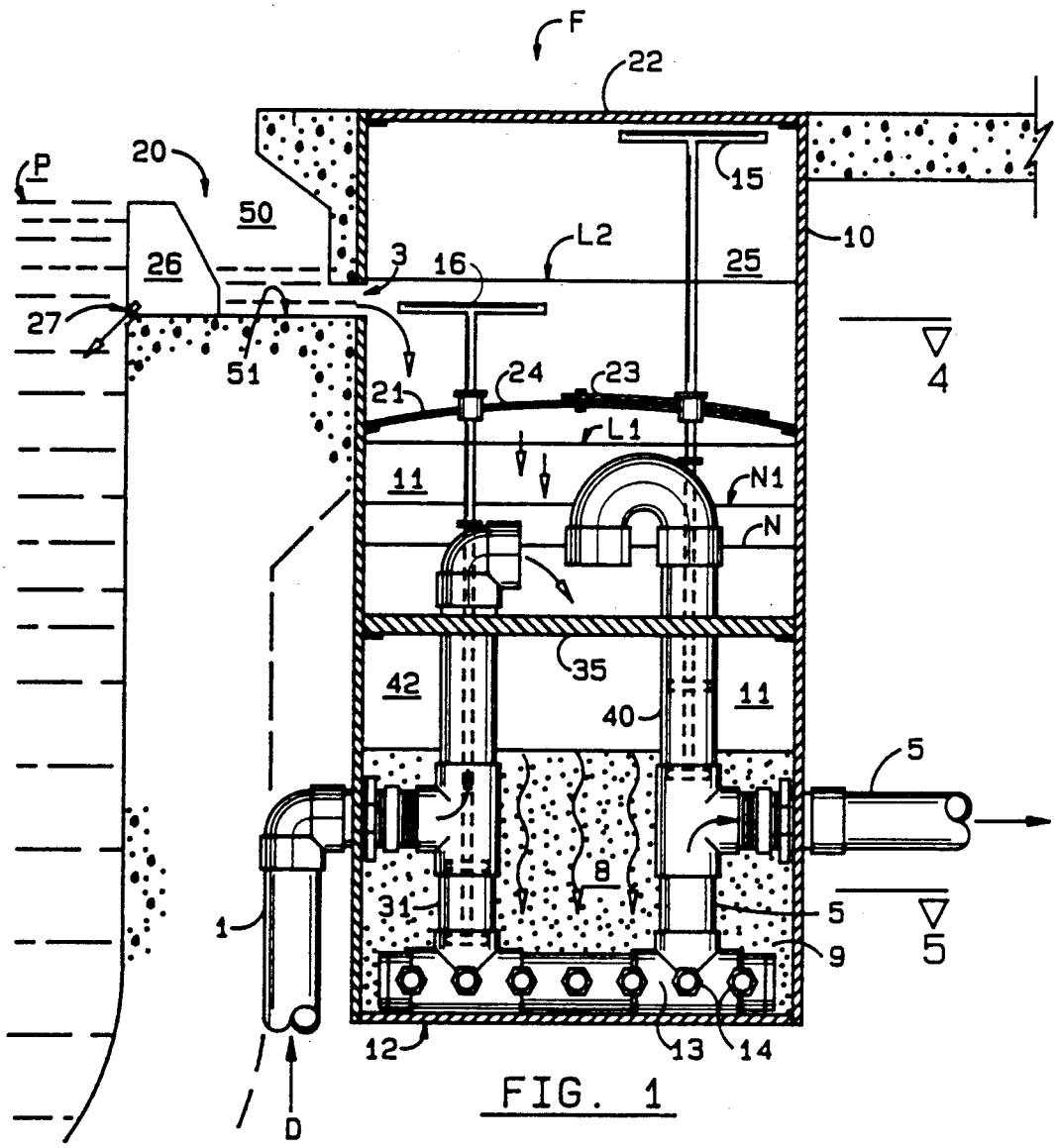
FIG. 1 represents a side view of one embodiment of a poolside perimeter and vacuum filter combination.

The vacuum filter of FIGS. 1 to 7 is generally of the design of U.S. Pat. No. 4,127,485, but modified in accordance with the present invention to introduce the suction backwash feature by inserting a partition separating and making it possible to close off the filter compartment from atmospheric pressure during backwash, and also to adapt it to a poolside location and function. The filter has a filter tank 10 with a filter compartment 11 and with inlet line connection 1 from the main drain D of the swimming pool P (see FIG. 6); a main drain control valve 16 can be interposed in line 1. Inlet connection 3 is provided for gravity feed of water from the perimeter gutter system 20. Both inlets lines 1, 3 feed into filter compartment 11 above the filter bed 8.

The filter tank 10 is designed to receive water to be filtered by gravity flow from the swimming pool P. For ease of access, the tank is directly beside the perimeter gutter 20, with the removable top 22 level with the ground surface. The partition 21 seals off the upper space in the tank from the filter compartment 11, and has a manually operated slide valve 23 controlling flow through the aperture 24 from line 3 to the filter bed 8. The walls of the tank are high enough to contain water from the pool within the tank, without overflowing, when the pool and tank are filled. Water from the swimming pool P when the main drain control valve 16 is open flows by gravity into the space 11 below partition 21, and above screen 35, and will fill the compartment 11 with water to a level N corresponding to the normal operating level of the water in the swimming pool. When the filter system is in operation, the valve 16 is throttled to reduce the flow from the main drain until the water flowing through the filter is equalized at the level N (minimum operating level) with all water coming through the main drain without any flow from the perimeter gutter overflow. Valve 16 will normally be positioned to direct flow to the filter when the filter is onstream, and valve 16 is positioned to open line 31 to permit flow to the manifold 12 when the filter is being cleaned by backwashing, as will presently be seen. If repairs to the tank are needed, or the filter bed is to be replaced, then the valve 16 can be positioned to prevent water flow from the pool through the main drain line 1 into the filter compartment 11.

Connected to the main drain line 1 at the main drain control valve 16 is line 31 which is in flow connection with the filter underdrain manifold 12 composed of a header line 13, extending across the compartment, with lateral feeder pipes 14 extending at right angles therefrom across the bottom 9 of the compartment 11. Water can flow in either direction through the manifold 12 and header-lateral feeder pipe system 13, 14, upwardly during backwash, for distribution of unfiltered water from the main drain 1, through valve 16 and line 31 to the bottom 9 of the compartment 11, or downwardly during filtration for collection of filtered water from the bottom 9 of the compartment 11.

Figure 3:
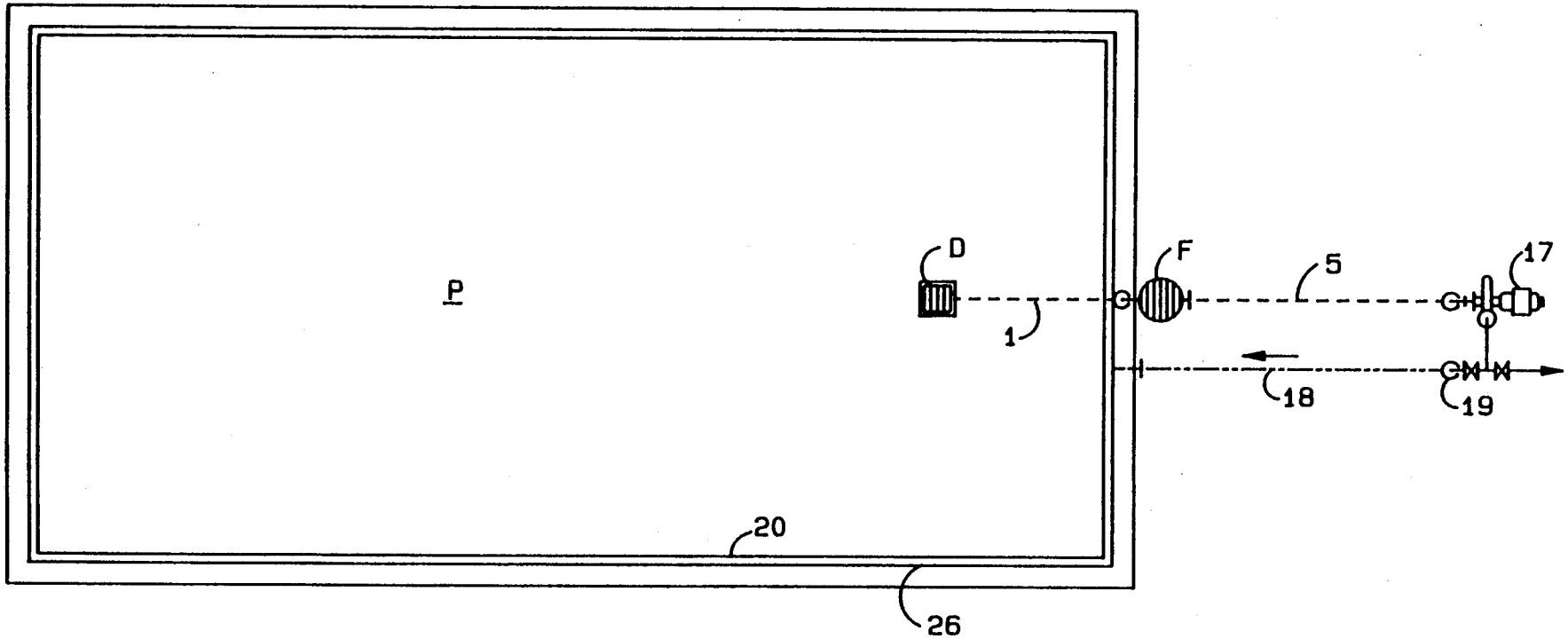
FIG. 3 represents a top or plan view of the embodiments of FIGS. 1 and 2.

At its outlet end, the manifold 12 and header system 13, 14 are in flow communication via line 5 and valve 15 to the water recirculation pump 17 (see FIG. 3). In normal on-stream operation, the water at the bottom of the compartment will be clean, having passed through filter bed 8, and passes via laterals 14 and suction header 13 through line 5 and valve 15, which is open when the filter is on-stream, through the recirculating pump 17, and is then returned to the swimming pool via return line 18 and filter return valve 19 to the clean water feed conduit 26 at the pool perimeter, beside the gutter 20, and thence into the pool via inlets 27.

It will be noted that inlet 3 from the gutter 20 feeds water in the upper portion of the compartment 11, above partition 21, at a level well above the level N and the line 1 from the pool P. At its outlet end in the compartment 11, the inlet 3 is at a level low enough for water to flow by gravity from the gutter system 20 through the inlet 3 into the compartment 11, in a manner similar to the gravity flow from the swimming pool P via the main drain D and line 1 into compartment 11.

Extending horizontally all the way across the compartment 11 below partition 21 above the top of the particulate filter bed 8 is a stainless steel or corrugated fiberglass equalization screen 35, serving as a flow distribution plate. The bed 8 is of sand, having a particle size not less than 0.45 mm and not exceeding 0.55 mm, but other particulate filter materials can be used, in single or multilayers, including for example charcoal and gravel of the same or various particle sizes. It is frequently desirable to arrange the bed in layers, with the layer of the largest or coarsest particles on the bottom, and the layer of the finest particles towards the top, to provide a continually increasing pore size in the bed in the direction of fluid flow, for more efficient filtration, and also to facilitate cleaning the bed by backwashing. It will be seen that the particulate filter bed 8 completely surrounds and embeds the header and manifold system 12, 13, 14 at the bottom 9 of the compartment 11.

The operation of the recirculation pump 17 withdraws water from the bottom 9 of compartment 11 via the manifold system 12, 13, 14 and outlet line 5. Consequently, suction is applied to the downstream face of the filter bed 8. Since the fluid pressure on the upstream side of the bed is the total of atmospheric pressure plus the static head of water pressure in the filter compartment 11, the effect of the pump suction in drawing a vacuum on the downstream side of the bed aids in inducing water to percolate uniformly through all parts of the bed.

Above the top of the stainless steel equalization screen 35 is a backwash line 40 connected via valve 15 and line 5 with the recirculation pump 17, or alternatively connected directly to waste. The entrance to line 40 is placed approximately 6 inches above the equalization screen, thus ensuring adequate head gradients under backwashing conditions.

The screen 35 has the function of breaking up any turbulent flow at the top of the compartment 11, due to the inrush of water through the inlets 1, 3. The screen apertures are small enough to filter any large debris that might pass into the filter compartment 11 via inlets 1, 3 from the pool P or gutter system 20.

In operation, with the vacuum filter on the filtering mode, the main drain control valve 16 is open (or partially open). On the downstream side of the filter, the valve 15 is open, permitting the water in the header and manifold system 12, 13, 14 to pass to the recirculating pump 17, for recirculation via line 18 back to the swimming pool.

The pump is operated, causing a vacuum in the header and manifold system 12, 13, 14. Dirty water from the main drain D of the swimming pool P enters the compartment 11 via line 1 and dirty water from the gutter system 20 enters via inlet 3 directly into the compartment 11. All such water passes downwardly through the sand filter bed 8, enters the header manifold system 12, 13, 14 and then passes via line 5 and valve 15 to the pump 17, and back to the pool via the filtered water return line 18.

When the minimum operating level N is established in compartment 11 by throttling main drain valve 16, this is the minimum operating level to which, at the normal recirculating rate, the level in compartment 11 can draw down to, with no water from the gutter 20 entering compartment 11 via inlet 3.

Under normal quiescent conditions, with approximately 50% of the water coming from the main drain 1 through valve 16 into compartment 11, and 50% of the recirculating rate coming via inlet 3 into the filter compartment 11, a somewhat higher normal operating level N1 is established, wherein the increase in water level caused by the inflow of approximately 50% of the recirculating rate via inlet 3 into the compartment 11 raises the water level to this level, and in turn applies additional head on the main drain line 1 and thereby reduces the amount of flow coming from the main drain, so that at level N1 approximately 50% of the recirculating rate is coming through each of the main drain line 1 and the inlet 3.

As activity in the pool increases, due to a number of bathers entering the water, gravity gutter water flow via inlet 3 will increase. When the gutter flow increases, the water level in the compartment 11 rises above the normal operating level N1 toward a higher level, indicated as L1. As the water level rises, it reduces the effective head available to cause water to flow from the main drain line 1 into the compartment 11. This automatically reduces main drain flow into the compartment 11, and compensates for the increased gravity flow via inlet 3 from the gutter system 20, thus making it possible for the water recirculation system to accommodate the increased flow from the gutter system by reducing intake from the main drain.

As the pool activity increases further, the water level in the filter chamber 11 continues to rise, due to further increased gravity flow via inlet 3. This continues to cause further throttling back of the main drain flow, to compensate for the increased gutter flow.

Further increase in pool activity to a maximum for the pool, reflected in gutter inlet flow via inlet 3, raises the water level further, to level L2. Only at this level is water recirculation system capacity at the maximum flow rate reached, and so the flow rate does not have to be increased, due to the size of inlet 3 and the pumping rate of the pump 17. Even at the maximum pool activity the gutter trough, inlet, and filter tank coupled with the recirculating flow drawn from the pump still provides sufficient draw down at the filter tank to handle the maximum flow coming from the gutter. This ensures that the gutter will not flood during the period of maximum pool activity, and that the filter tank will still provide enough water recirculating system capacity in compartment 11 to accommodate the increased flow from the gutter system through inlet 3.

When the activity in the pool decreases, the flow of water from the gutter also decreases, and the level of water in the compartment 11 consequently decreases. As it does so, the throttling effect on main drain flow also decreases. When the water level goes below L1 and reaches level N1, normal operating conditions are restored at level N1, with approximately 50% of the recirculation flow coming through the main drain valve 1 and 50% through perimeter overflow line 3.

Thus, at all degrees of activity in the pool, a balance is maintained between main drain flow via line 1 entering the compartment 11 and gutter flow via inlet 3 entering the compartment 11 from the gutter system. This balance is proportional to activity in the pool.

From time to time, the accumulation of dirt removed by the sand bed 8 in the space 42 between the plate 35 and the top of the sand bed 8 increases differential pressure across the sand bed, and reduces effectiveness of the filter by reducing flow through the filter. In order to prevent starvation of the pump, and a diminution in water recirculation flow, it becomes necessary to clean the filter. The valves 15, 16 are accordingly adjusted to put the filter in the cleaning mode for backwash.

Preparation for backwash requires that the recirculation pump 17 be turned off. Valve 16 is positioned to close off flow to the top of the filter bed 8, and open line 31 for backwash flow to underdrain manifold 12, 13, 14. Valve 15 is positioned to open line 5 to flow from line 40 and close off the manifold 12 from line 5. Valve 23 is closed, thus making it possible to draw an effective contaminant cleaning suction in compartment 11 and suction backwash flow upwardly through the bed, when the pump is turned on again.

Accordingly, water entering the filter from the main drain line 1 now flows by gravity through valve 16 and line 31 into the header and manifold system 12, 13, 14, and thence percolates upwardly through the sand filter bed 8, carrying with it dirt accumulated on the surface of the sand bed, passes through the stainless steel equalization screen 35, enters the backwash drain line 40, and proceeds through valve 15, whence it is pumped to waste by recirculating pump 17, which is then turned on again. A vacuum is now drawn in compartment 11, via the pump suction.

The suction vacuum drawn in compartment 11 provides the backwash flow through the filter bed, as it does during filtering, except that flow is in the reverse direction, thus ensuring laminar flow, and uniform complete cleansing and backwashing of all parts of the filter bed 8.

After the filter bed has been cleaned, the filter can be put back on-stream in the filter mode. The valves 15, 16 and 23 are manually restored to the positions shown in FIG. 1. Water can then enter the filter compartment 11 above the screen 35. The recirculation pump 17 is restarted, and the filter is again on-stream, in the filter mode, since the valve 23 is open for flow from inlet 3.

The vacuum drawn on the filtered water in the header and manifold system 12, 13, 14 and downstream thereof will aid in removing dissolved gases in the dirty water. The gases will accumulate in the bottom portion of the filter bed 8. To vent them, the following system can be used. From time to time, a time clock controlling the recirculation pump 17 can automatically stop the pump for a brief period, so that the bubbles of gas collected in the bed can migrate upwardly into compartment 11. They can do so because they no longer have to fight a flow of water through the bed in the opposite direction. When the pump is turned off, the water in the filter tank rises to equal the level in the pool, submerging inlet 3 so the gasses escape through the filter cover 22.

Figure 2:
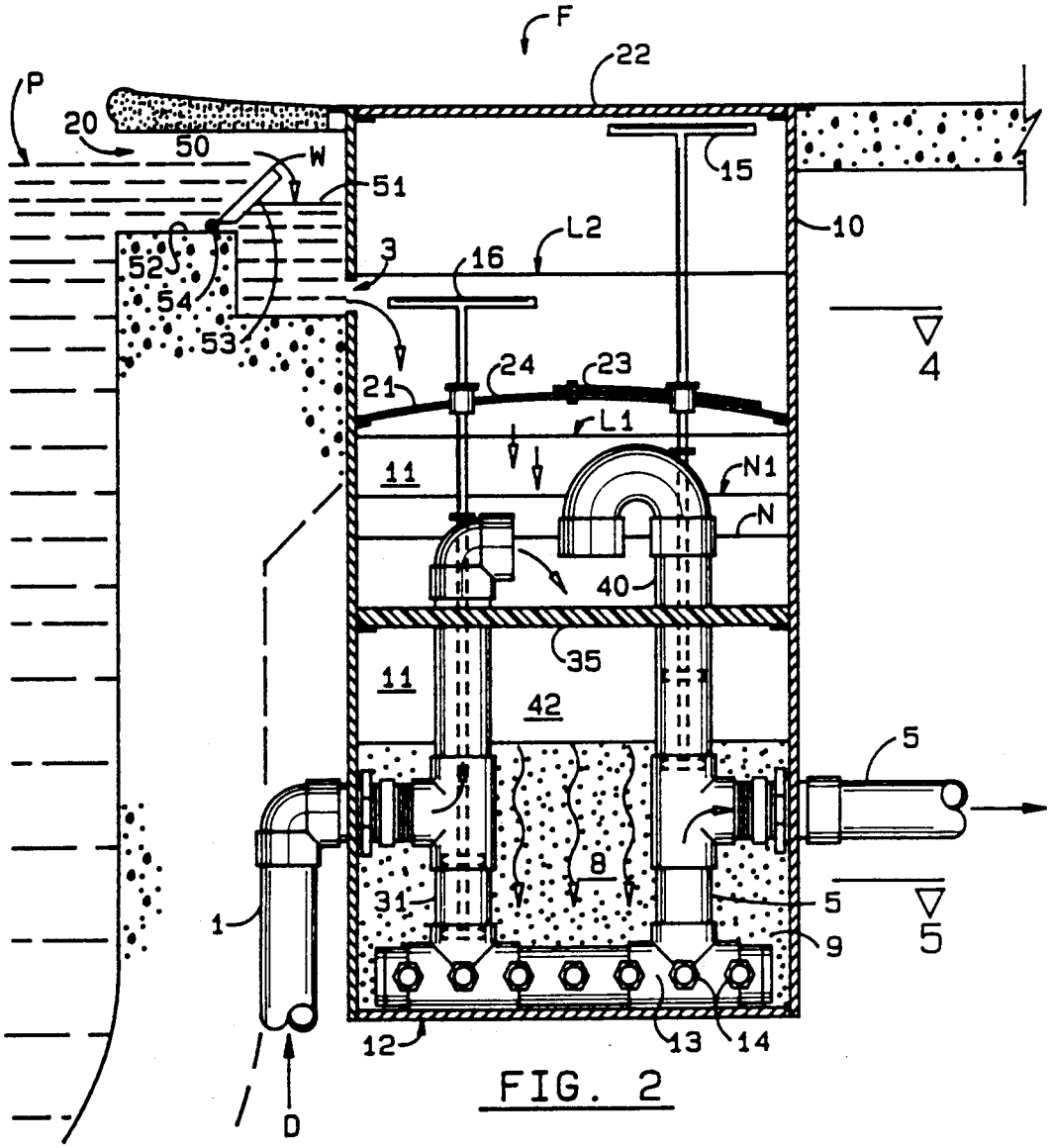
FIG. 2 represents a side view of another embodiment in which a flap-type surface skimmer is directly connected with a filter of FIG. 1, and without a gutter.

The system shown in FIG. 2 is designed for use with a gutterless swimming pool provided with a buoyant skimmer flap-type weir W feeding a skimming flow of pool water directly to the filter tank inlet 3. The vacuum filter F is the same as that of FIG. 1, and the water recirculation system is also the same as that of FIG. 3.

The weir flow passage 50 is connected at the stepped-down inner end 51 to the inlet 3 of the filter tank 10. Flow from the pool P through the passage 50 is controlled by buoyant skimmer flap 53, anchored to the bottom 52 of the passage on a pivot pin 54, so that the flap can swing up and down on the water level in the passage. In the normal case, approximately 30 gallons per minute is drawn from each skimmer, so that inlet 3 is sized to accommodate this flow. As the water level in the pool varies under quiescent conditions, the flap floats up and down, corresponding to the pool level, to permit the desired 30 gpm to come over the top of the flap. When activity in the pool increases, the only increase in the water level in passage 50 is the wave action, and the flap rides the waves as best it can while still providing the 30 gpm skimming action. Inlet 3 can be adjusted to provide flows greater than 30 gpm, if this is desired, but the principle of the float action remains the same. A plurality of weirs W can be provided, according to the size of the pool and the required skimming flow, all preferably feeding pool water to inlet 3 via a common feed line.

Accordingly, the poolside filter and water recirculation system in accordance with the invention makes it possible automatically to accommodate any amount of pool activity without gutter flooding or washing back of debris and contaminants in the gutters into the pool, permitting skimming flow through surge weirs and/or over the perimeter rim, as may be desired.

The weir or weirs for skimming flow can be skimming slots, as in U.S. Pat. Nos. 3,668,712 and 3,668,714, the slots feeding water directly into the second gutter conduit, and thence to the filter inlet 3.

Figure 6:
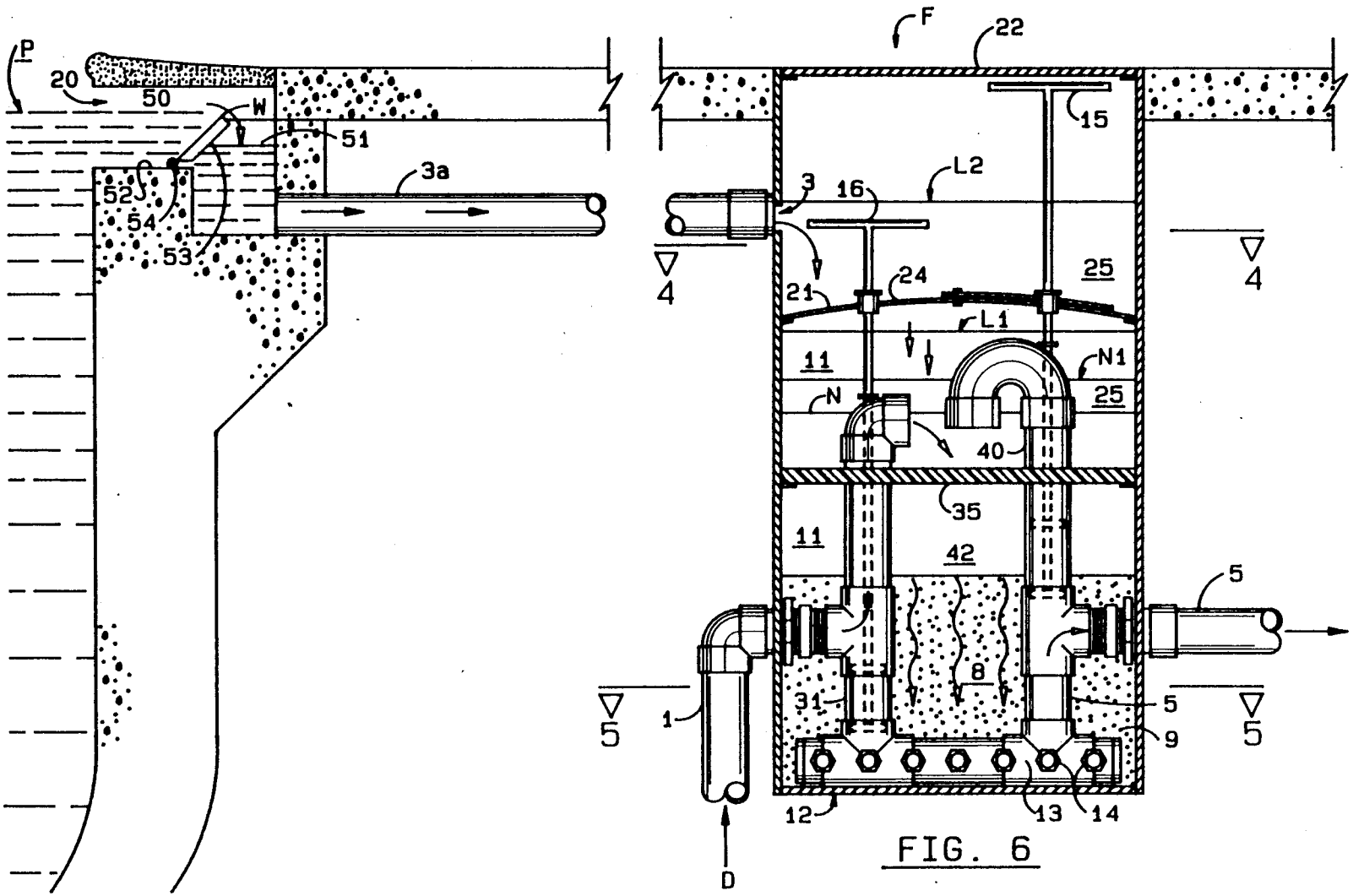
FIG. 6 is a top or plan view showing a water recirculation system and a swimming pool, with a filter of FIG. 1 in a remote location.
Figure 7:
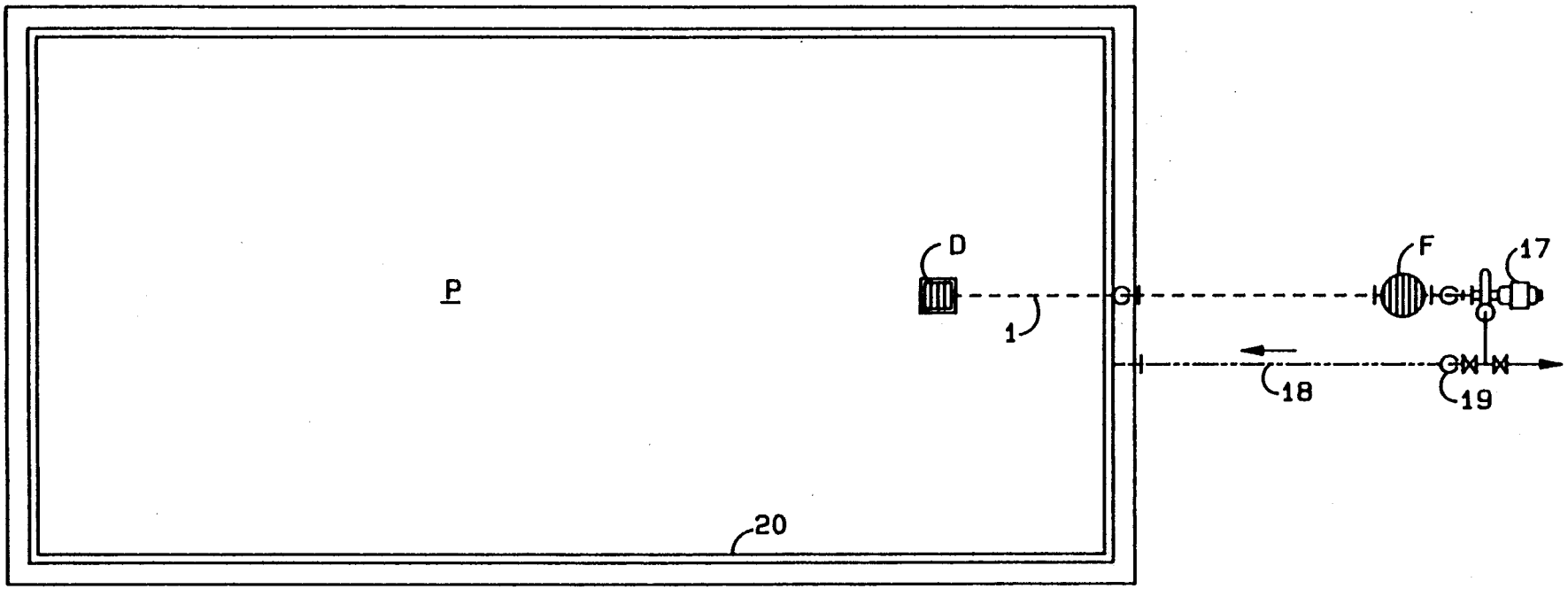
FIG. 7 represents a top or plan view showing the line connections between the filter of FIG. 6 and the swimming pool main drain.

The system shown in FIGS. 6 and 7 is similar to that of FIGS. 2 and 3, except that the vacuum filter F is underground at a location remote from the pool P. The system is designed for use with a gutterless swimming pool P provided with a buoyant skimmer flap-type weir W feeding a skimming flow of pool water to the conduit 3*a* that leads to the filter tank inlet 3. The vacuum filter F is the same as that of FIG. 1, and the water recirculation system is also the same as that of FIG. 3.

The weir flow passage 50 is connected at the stepped-down inner end 51 to the conduit 3*a*. Flow from the pool P through the passage 50 is controlled by buoyant skimmer flap 53, anchored to the bottom 52 of the passage on a pivot pin 54, so that the flap can swing up and down on the water level in the passage. In the normal case, approximately 30 gallons per minute is drawn from each skimmer, so that conduit 3*a* is sized to accommodate this flow. As the water level in the pool varies under quiescent conditions, the flap floats up and down, corresponding to the pool level, to permit the desired 30 gpm to come over the top of the flap. When activity in the pool increases, the only increase in the water level in passage 50 is the wave action, and the flap rides the waves as best it can while still providing the 30 gpm skimming action. Conduit 3*a* can be adjusted to provide flows greater than 30 gpm, if this is desired, but the principle of the float action remains the same. A plurality of weirs W can be provided, according to the size of the pool and the required skimming flow, all preferably feeding pool water to conduit 3*a* via a common feed line.

Accordingly, even with the filter in a pool-remote location, the filter and water recirculation system in accordance with the invention makes it possible automatically to accommodate any amount of pool activity without gutter flooding or washing back of debris and contaminants in the gutters into the pool, permitting skimming flow through surge weirs and/or over the perimeter rim, as may be desired.

Figure 4:
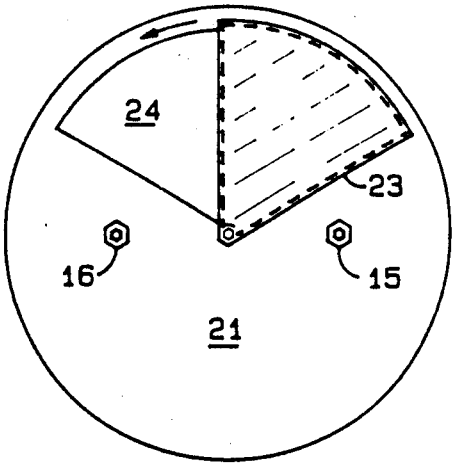
FIG. 4 is a top view, partly in section, taken along the line 4—4 of FIG. 2.
Figure 5:
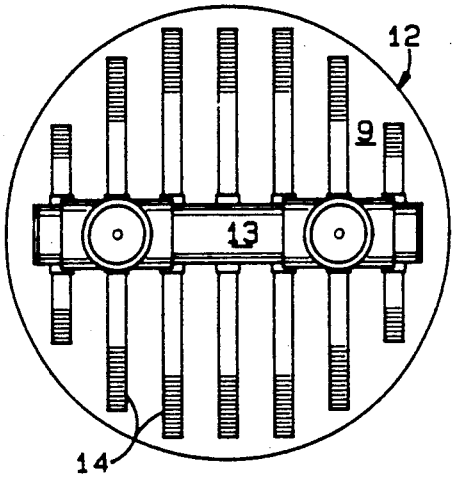
FIG. 5 is a top view, partly in section, taken along the line 5—5 of FIG. 4.
Figure 9:
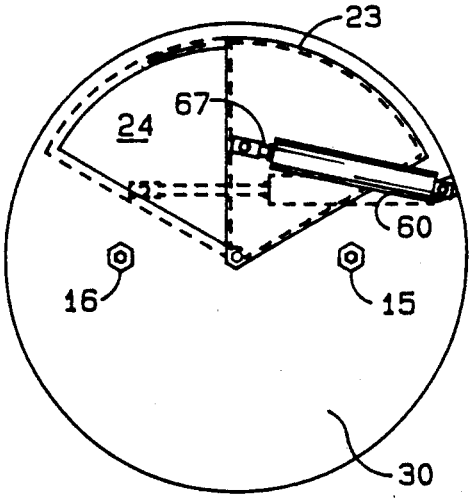
FIG. 9 represents a sectional view along the line 9—9 of FIG. 8 showing the automatically operated closure valve.
Figure 8:
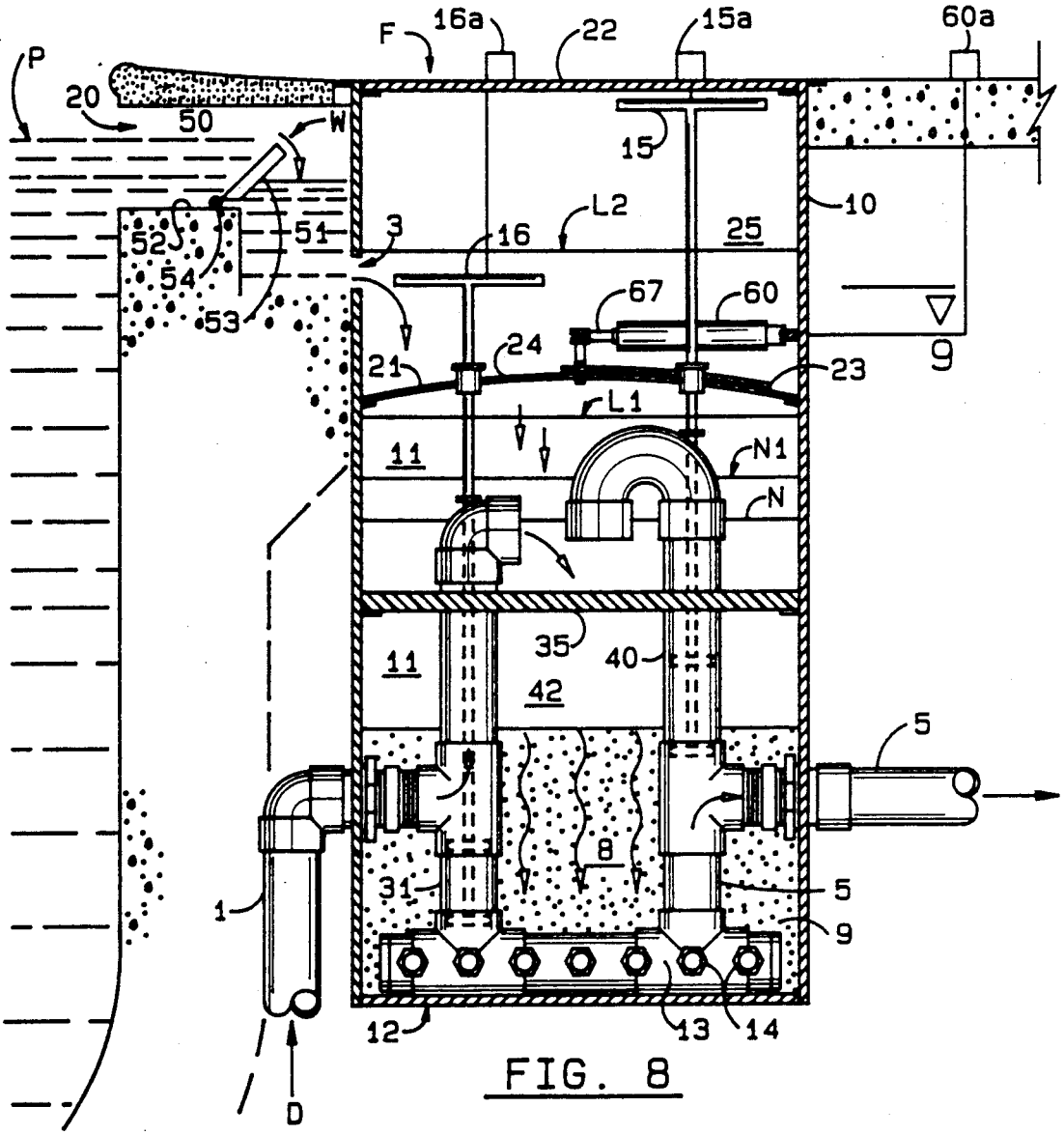
FIG. 8 represents a side view of an embodiment of poolside perimeter and vacuum filter combination having an automatically operated closure valve.

The vacuum filter of FIGS. 8 and 9 is generally of the design of FIGS. 1 and 4, but with the closure valve 23 operated automatically by the two-position reciprocating hydraulic cylinder 60 with a plunger 67. At the time the valves 15, 16 are closed, the plunger 67 is activated by a solenoid valve (not shown), extending the plunger 67 and sliding the valve 23 to the closed position, to close off the filter compartment during backwash, thus making it possible to draw an effective contaminant cleaning suction in compartment 11 and suction backwash flow upwardly through the bed.

The suction drawn in compartment 11 provides the backwash flow through the filter bed, as it does during filtering, except that flow is in the reverse direction, thus ensuring laminar flow, and uniform complete cleansing and backwashing of all parts of the filter bed 8.

After the filter bed has been cleaned, the filter can be put back on-stream in the filter mode. The valves 15 and 16 are restored to the positions shown in FIG. 1, and the plunger 67 is again actuated, to open valve 23. Water can then enter the filter compartment 11 from line 1 through valve 16 above the screen 35. The recirculation pump 17 is restarted, and the filter is again on-stream, in the filter mode, with the valve 23 open for flow from inlet 3.

Figure 11:
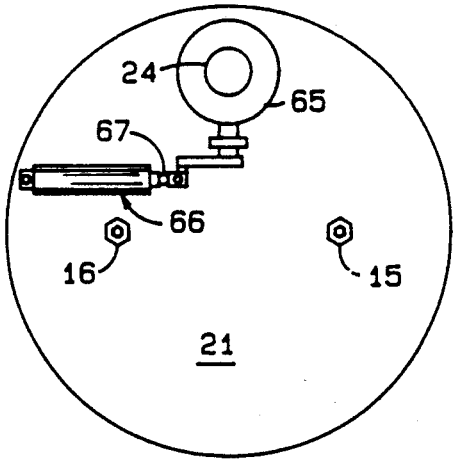
FIG. 11 is a sectional view taken along the line 11—11 of FIG. 10, showing the closure valve.
Figure 10:
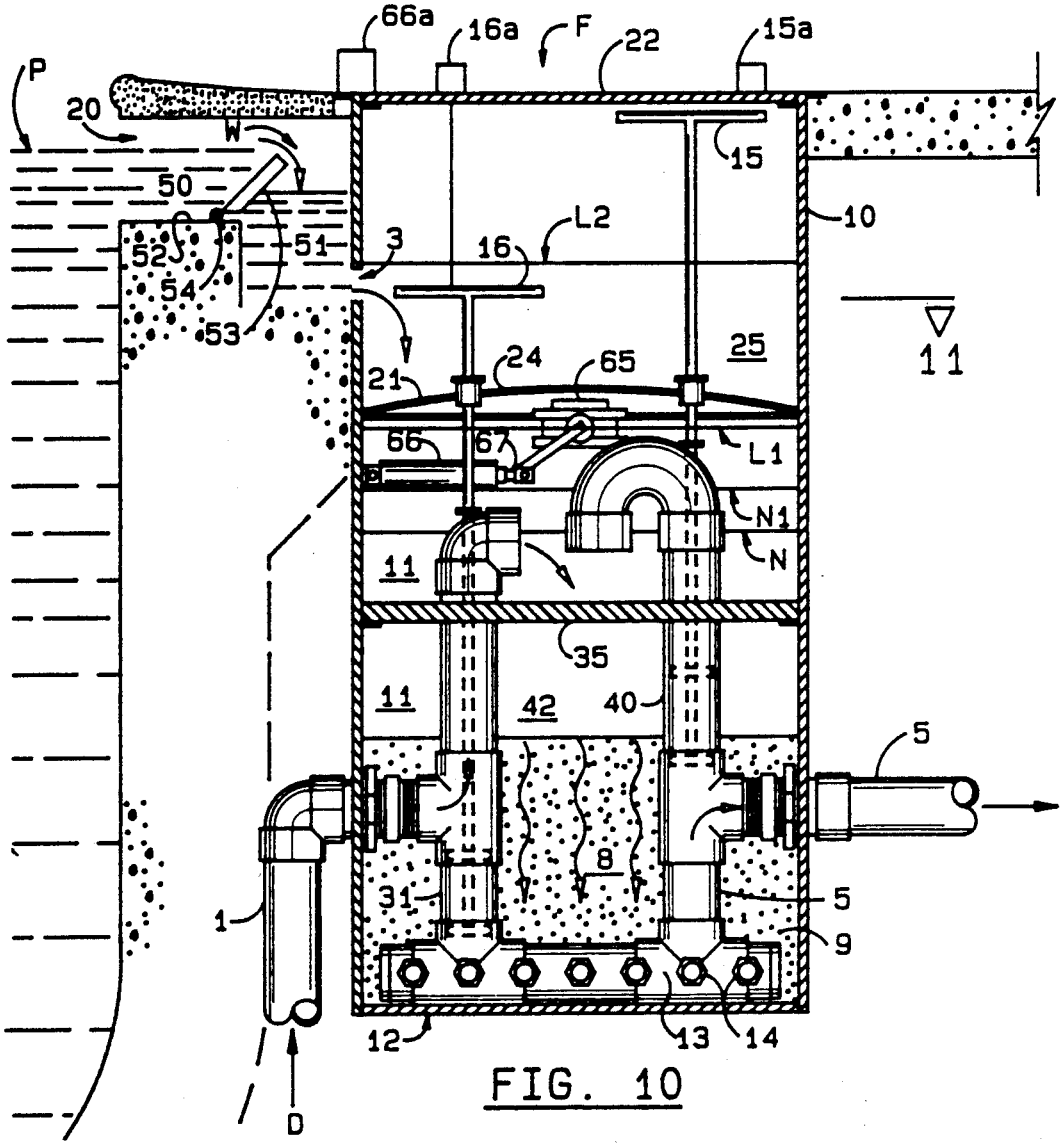
FIG. 10 represents a sectional view along the line 10—10 of FIG. 9, showing another embodiment in which an automatic plug valve serves as the closure valve.

The vacuum filter of FIGS. 10 and 11 is generally similar to that of FIGS. 8 and 9, except that slide closure valve 23 is replaced by a wafer valve 65 that is automatically raised and lowered between open (shown in FIG. 10) and closed positions by the hydraulic two-position reciprocating cylinder 66. A solenoid valve (not shown) is actuated to extend plunger 67 and place valve 65 in the closed position, thus making it possible to draw an effective contaminant cleaning suction in compartment 11, and suction backwash flow upwardly through the bed.

The suction drawn in compartment 11 provides the backwash flow through the filter bed, as it does during filtering, except that flow is in the reverse direction, thus ensuring laminar flow, and uniform complete cleansing and backwashing of all parts of the filter bed 8.

After the filter bed has been cleaned, the filter can be put back on-stream in the filter mode. The valves 15 and 16 are restored, and the switch is again actuated to return cylinder 66 and plunger 67 to the positions shown in FIG. 10. Water can then enter the filter compartment 11 above the screen 35. The recirculation pump 17 is restarted, and the filter is again on-stream, in the filter mode, with the valve 65 open for flow from inlet 3.

The weir or weirs for skimming flow can be skimming slots, as in U.S. Pat. Nos. 3,668,712 and 3,668,714, the slots feeding water directly into the second gutter conduit, and thence to the conduit 3*a*.

Figure 12:
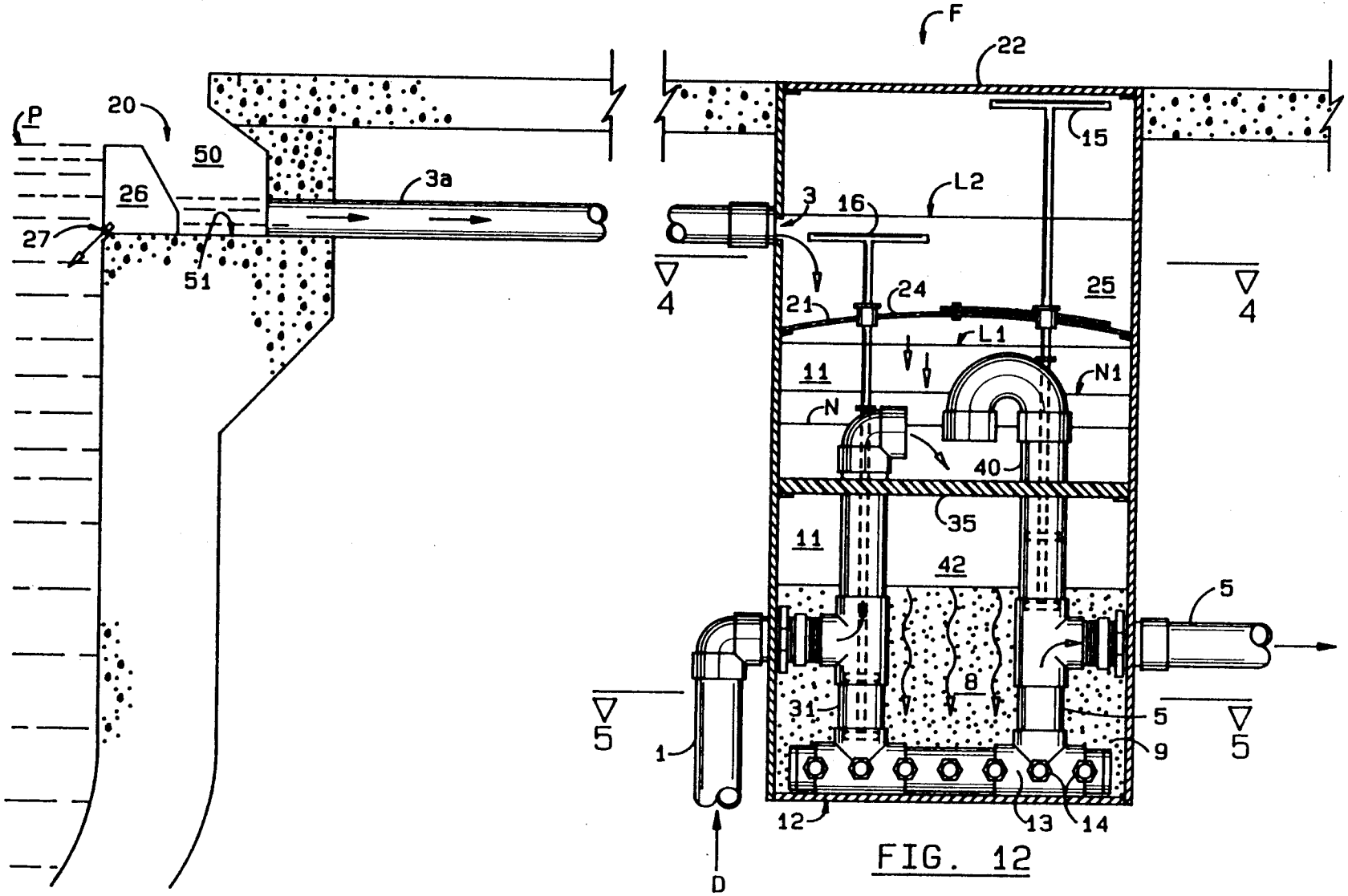
FIG. 12 represents a side view of another embodiment of pool with a perimeter gutter and a vacuum filter in a remote location and having an automatically operated closure valve.
Figure 13:
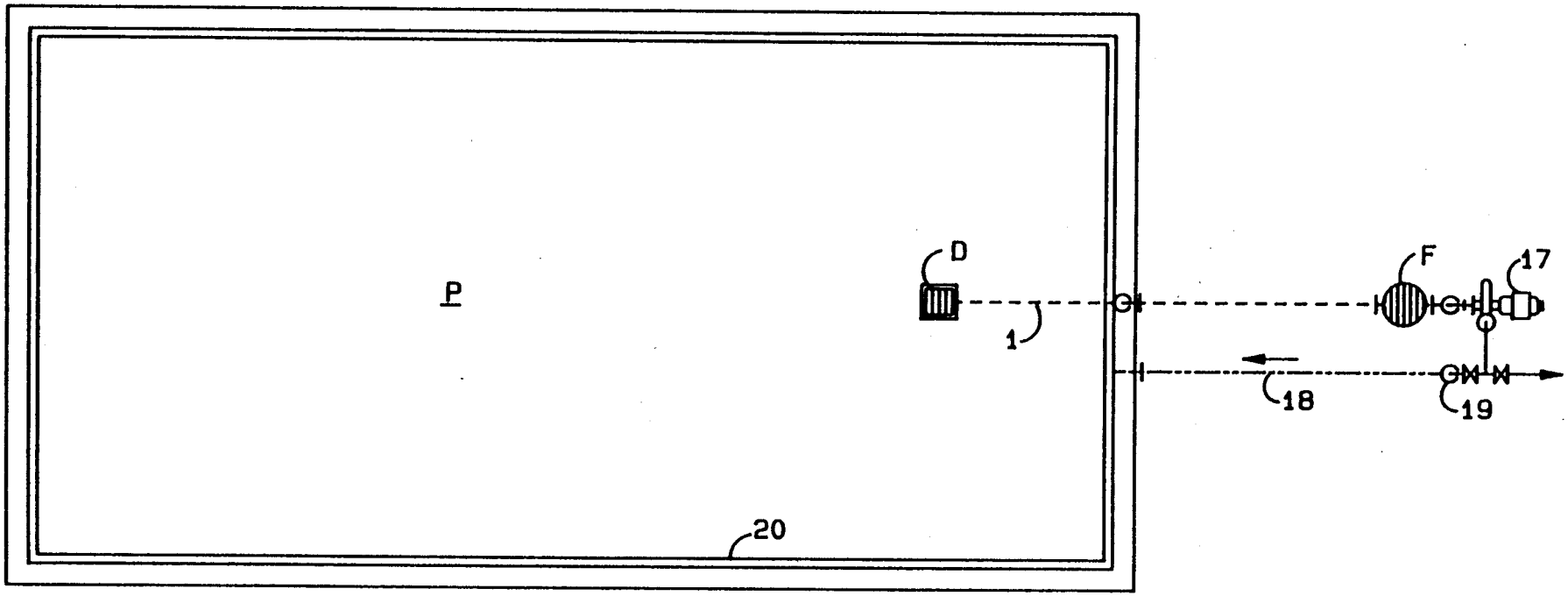
FIG. 13 represents a top or plan view showing the line connection between the filter of FIG. 12 and the swimming pool.

The system shown in FIGS. 12 and 13 is similar to that of FIGS. 1 and 3, except that the vacuum filter F is underground at a location remote from the pool P. The system is designed for use with a perimeter gutter swimming pool P, as shown in FIG. 1, feeding a skimming flow of pool water to the conduit 3*a* that leads to the filter tank inlet 3. The vacuum filter F is the same as that of FIG. 1, and the water recirculation system is also the same as that of FIG. 3.

The vacuum filter and water recirculation system of the invention is applicable to any design of single or multiple gutter perimeter gutter system.

U.S. Pat. No. 3,668,712 to William H. Baker dated June 13, 1972, provides a perimeter dkimming gutter for swimming pools including a gutter conduit for disposition about the perimeter of a swimming pool and adapted to carry water at a level below a predetermined level of water in the swimming pool, a retaining wall on the pool-side of the conduit, over the top of which wall water may flow from the pool into the gutter conduit, and a plurality of narrow elongated substantially horizontally disposed openings through the wall at a height to maintain a predetermined water flow, the top of the wall being spaced above the openings at a height to retain the pool water within the pool perimeter at water flows, wave actions and surges up to a predetermined maximum, while allowing excessive water flows, wave actions and surges beyond such maximum to flow over the top of the wall into the gutter conduit.

U.S. Pat. No. 3,668,714 to William H. Baker dated June 13, 1972, provides a nonflooding perimeter skimming gutter for swimming pools including a first gutter conduit for disposition about the perimeter of a swimming pool, and adapted to carry water at a level below a predetermined level of water in the swimming pool, a retaining wall on the pool-side of the first gutter conduit over the top of which wall a skimming flow of water may run from the pool into the first gutter conduit, a second gutter conduit adapted to carry water at a level below a predetermined level of water in the first gutter conduit, and a fluid flow connection between the two gutter conduits at such level and below the top of the retaining wall allowing water flow from the first gutter conduit into the second gutter whenever the water level on the first gutter conduit reaches the fluid flow connection, thereby inhibiting filling of the first gutter conduit appreciably above such level.

Both skimming gutter designs are quite satisfactory for most sizes of swimming pool. If their unusually large gutter capacity can at times be exceeded, then the gutter of U.S. Pat. No. 3,815,160 to William H. Baker, dated June 11, 1974, can be used.

This nonflooding perimeter skimming gutter wall permits an adequate skimming action at all times, and also provides for virtually unlimited surge, capacity when the pool is in use, without the possibility of the gutter's flooding, or dirt in the gutter's being washed back into the pool. This is accomplished by combining a second gutter conduit within a peripheral wall of the swimming pool, making available for gutter flow the internal volume of the wall, in fluid flow connection with the first gutter conduit, and adapted to receive water from the first gutter conduit whenever the level of water in that gutter exceeds a predetermined maximum, established at the level of the fluid flow connection therebetween. This fluid flow connection is below the top of the retaining wall, so that the water level in the first gutter conduit cannot reach the top of the retaining wall. The second gutter conduit within the wall is entirely separate from the first, and is designed to provide an ample reserve flow capacity to accommodate any heavy or surge action that may be likely to be encountered. The fluid flow connection between the gutter conduits can be arranged to skim the dirt off the top of the first gutter trough, thus assisting in preventing this dirt from being washed back into the pool.

In this gutter system, the water level in the pool is normally maintained at the level at the top of the retaining wall, which consequently serves as a skimmer gutter at the pool perimeter. The fluid flow connection may constitute a second skimming flow outlet, supplementing and continuing the skimming action of the first.

The term "conduit" as used herein is inclusive of open conduits or troughs as well as partially or wholly enclosed conduits.

In a preferred embodiment of the invention the first gutter conduit is an open trough, with at least one fluid flow connection with the second gutter conduit in the form of one of a plurality of openings at the predetermined maximum level of water in the first gutter conduit.

The second gutter conduit preferably is a closed conduit. The second gutter conduit can be within any peripheral wall of the pool. It can, for example, be within the peripheral pool-side retaining wall. It can also be within a peripheral external wall of the gutter, on the side away from the pool.

In a preferred embodiment of the invention, a water-feed conduit is provided in the gutter for feed of fresh water into the pool. This conduit is preferably as integral part of the nonflooding perimeter skimming gutter, at the pool-side retaining wall, admitting water to the pool through the pool-side retaining wall.

In the case where the two gutters are separated by a common wall, the fluid flow connection between the two gutters can be of any configuration, and is in sufficient number and at a high enough level to provide for an adequate flow capacity, to prevent the water level in the first gutter conduit from appreciably exceeding the height of the overflow connection under any water surge or wave conditions in the pool.

The level of the overflow connections with respect to the bottom of the first gutter conduit can be adjustable, so as to provide adjustment of the water level permitted in the first gutter conduit before flow via the overflow connections into the second gutter conduit commences. This adjustment can be provided for by forming the overflow connections as vertical slots or with an extended vertical height, and disposing a movable barrier member over the overflow connections with the opening or openings of the desired size and shape.

Variations of the filter design shown in the Figures will be apparent to those skilled in the art.

The valves controlling flow between the pool and the filter tank and between the inlet and outlet lines can be float-controlled or actuated by an external power source, such as mechanically, electrically, pneumatically, or hydraulically.

The particulate material composing the filter bed can be composed of sand and/or rock of the same or different grades, in admixture or in several layers. The layers can for example be laid down with increasing coarseness from bottom to top within the tank. For example, the layers can comprise a topmost layer of No. 20 sand. This layer will preferably be the thickest, and can be approximately one half of the filter bed. A second layer of No. 12 sand can be placed directly below the first layer. This will be of substantially less thickness than the preceding layer. The next layer can be a layer of rock of one eighth to one quarter inch in diameter. This layer will be approximately equal in thickness to the preceding layer. The bottommost and coarsest layer can be composed of one quarter to one half inch rock, and this will fill the remainder of the space in the tank.

It is also possible to employ a bed composed of a single layer of one grade of sand, as illustrated in the embodiment shown in the drawings. Materials such as charcoal, vermicultie, perlite, and other suitable filter materials can be included, alone or in admixture, and the particular thickness, position or coarseness of any given layer or of the entire bed will be selected with reference to the requirements of the system to which the filter is connected.

The influent and effluent lines and connections can be formed from available pipe and plumbing fixtures.

The tank influent and effluent line and other parts of the filter can be formed of steel, stainless steel, aluminum, copper, brass and the like, and is preferably of corrosion-resistant or corrosion-resistant-coated metals. Plastic materials also can be used, particularly polytetrafluorethylene, polypropylene, polyethylene, polystyrene, and polycarbonate resins, either entirely or as coatings.

Above and below the bed there can be arranged screens or mesh filters or other apertured retainers which support the particulate material of the bed, and prevent migration of the particles downstream under either normal or reverse flow. These screens can be held in the tank supports, so as to be kept away from the sides and bottom of the tank.

Flat filter meshes and screens can also be used, alone or in combination with other supports, interposed among and between the various layers of the filter bed, to provide added filtration and layer separation. A relatively coarse screen which is adapted to be readily removed or easily reached for cleaning can be provided above the topmost layer, to remove gross-size contaminants such as leaves, twigs, bugs and the like, which may enter the filter through the water recirculating system from either the pool or the gutter. Fibrous filter media are also suitable.

The drawings show open and closed tanks. A closed tank can be formed with a removable lid, or in sectional portions which can readily be separated for cleaning. The juncture of the lid or sections of a tank can be formed by providing gasketed mating flanges on each of the two mating sections, or the lid or the tank body. Such flanges can be clamped together in a relatively fluid tight gasketed seal quite easily, and means for clamping the flanges together are well known. The preferred arrangement however is to form the tank as a single unit providing manhole access through the top head.

The manifold and header water distribution system shown in the drawings is a preferred embodiment, but other arrangements can also be employed, arranged to distribute the water relatively uniformly throughout the volume of the filter. While the drawings, FIGS. 1 to 11, show a cylindrical shape for the filter tank, the filter tank can also be rectangular, in which event the distributor can take the form of a rectangle, having a plurality of apertures distributed over its surfaces. The distributors can be disposed on parallel arms from a central or axial hub, and communicate with the manifold as the hub. Other configurations and dispositions of the distributor are possible, including a star configuration, a hollow disc configuration, and the like. In all cases, the member extending from the manifold will have a plurality of apertures distributed over their surface, for the passage of water therethrough.

Having regard to the foregoing disclosure, the following is claimed as the inventive and patentable embodiments thereof:

1. A vacuum filter for swimming pools comprising (a) a tank;

(b) a filter bed of particulate material in the tank having upstream and downstream filter surfaces with respect both to normal filtering water flow through the filter bed and to backwash flow in the reverse direction;

(c) a first inlet for communicating the swimming pool with the tank above the upstream filter surface for gravity flow into the tank and maintaining a predetermined level of water in the tank at a normal fluid pressure in relation to a level of water in the swimming pool;

(d) a second inlet for communicating the tank with a perimeter gutter or skimming weir for gravity flow into the tank above the upstream filter surface;

(e) a first outlet for communicating the tank with a pump in a water recirculation system for suction flow of filtered water from the tank and to the swimming pool;

(f) a closure means for controlling flow from the second inlet during reverse or backwash flow and providing a closed space in the tank at the upstream filter surface for maintaining a reduced below-normal fluid pressure in that space;

(g) a second outlet for fluid flow connection from the tank above the upstream filter surface to the upstream side of a pump for drawing a reduced below-normal fluid pressure in that space at the upstream filter surface;

(h) a third inlet in fluid flow connection with the downstream side of the filter bed for water feed in reverse or backwash flow through the filter bed for cleaning and carrying off contaminants collected on the upstream filter surface;

(i) a partition extending across the tank above the upstream filter bed surface, defining the closed space between the partition and the filter bed surface; and with the first inlet and second outlet opening into the closed space, and the second inlet opening into the tank on the side of the partition; an aperture through the partition communicating the second inlet with the closed space; and the closure means controlling flow through the aperture.

2. A vacuum filter according to claim 1 in which the closure means is a wafer valve pivotable between open and closed positions repsectively opening and closing the aperture.

3. A vacuum filter according to claim 1 in which the closure means is a slide valve pivotable between open and closed positions respectively opening and closing the aperture.

4. A vacuum filter according to claim 3 in which the valve is operated manually.

5. A vacuum filter according to claim 3 in which the valve is operated automatically.

6. A vacuum filter for swimming pools comprising (a) a tank;

(b) a filter bed of particulate material in the tank having upstream and downstream filter surfaces with respect both to normal filtering water flow through the filter bed and to backwash flow in the reverse direction;

(c) a first inlet for communicating the swimming pool with the tank above the upstream filter surface for gravity flow into the tank and maintaining a predetermined level of water in the tank at a normal fluid pressure, and in relation to a level of water in the swimming pool;

(d) a second inlet for communicating the tank with a perimeter gutter or skimming weir for gravity flow into the tank above the upstream filter surface;

(e) a first outlet for communicating the tank with a pump in a water recirculation system for suction flow of filtered water from the tank and to the swimming pool;

(f) divider means extending across the tank above the upstream filter bed surface, defining a first closed space between the divider and the filter bed surface; and a second closed space between the divider and the second inlet; the first inlet and first outlet opening into the first closed space, and the second inlet opening into the second closed space; and an aperture through the divider communicating the second closed space with the first closed space;

(g) closure means controlling flow from the second inlet into the first closed space; and (h) a second outlet for fluid flow connection from the tank above the upstream filter surface to the upstream side of a pump for drawing a reduced below-normal fluid pressure in the first closed space at the upstream filter surface; and (i) a third inlet in fluid flow connection with the downstream side of the filter bed for water feed in reverse or backwash flow through the filter bed for cleaning and carrying off contaminants collected on the upstream filter surface.

7. A vacuum filter according to claim 6 in which the closure means is a wafer valve.

8. A vacuum filter according to claim 6 in which the closure means is a slide valve.

9. A vacuum filter according to claim 6 in which the closure means is manually operated between open and closed positions.

10. A vacuum filter according to claim 6 in which the closure means is automatically operated between open and closed positions.

11. A vacuum filter according to claim 10 in which the closure means is a valve that is operated automatically by a reciprocating plunger.

12. A water cleaning and recirculation system for swimming pools comprising, in combination:

(1) a vacuum filter according to claim 6 receiving water from the swimming pool;

(2) a water recirculation system receiving water from the filter and returning it to the pool;

(3) the water recirculation system including a pump drawing a vacuum downstream of the vacuum filter and recirculating filtered water to the swimming pool.

13. A water cleaning and recirculation system for swimming pools according to claim 12, comprising a valve controlling flow between the gutter drain inlet and the filter tank.

14. A water cleaning and recirculation system for swimming pools according to claim 12, comprising a manifold and header line distribution system in the tank in fluid flow connection with the first inlet and the outlet to the water recirculation system.

15. A water cleaning and recirculation system for swimming pools according to claim 12, comprising an apertured flow distributor in the filter tank extending across the tank beneath the first and second inlet connections and above the filter bed.

16. A water cleaning and recirculation system for swimming pools according to claim 12, comprising a pump in fluid flow connection with the outlet from the filter tank, drawing a vacuum on the downstream side of the filter bed, for recirculating filtered water to the swimming pool.

17. A water cleaning and recirculation system for swimming pools according to claim 12, comprising a manifold and header line distribution system, and two valves in the filter tank, a first valve controlling flow into the tank from the first inlet to the filter bed, and the manifold and header line distribution system, and a second valve controlling water flow through the first outlet to the water recirculation system.

18. A water cleaning and recirculation system for swimming pools according to claim 17, comprising means for manually operating the valves between open and closed positions.

19. A water cleaning and recirculation system for swimming pools according to claim 17, comprising means for automatically operating the valves between open and closed positions.

20. A swimming pool comprising side walls and a bottom adapted to retain water therewithin, and a water cleaning and recirculation control system in fluid flow connection therewith comprising, in combination:

(1) a vacuum filter in accordance with claim 6;

(2) a water recirculation system including a pump drawing a vacuum downstream of the filter and recirculating filtered water to the swimming pool.

21. A swimming pool in accordance with claim 20, comprising a perimeter gutter receiving skimming flow and in flow communication with the second inlet of the vacuum filter.

22. A swimming pool in accordance with claim 20, comprising a skimming means in a perimeter wall of the pool below the top of the wall receiving skimming flow and in flow communication with the second inlet of the vacuum filter.

23. A swimming pool according to claim 20, in which the vacuum filter is beside the pool.

24. A swimming pool according to claim 23, comprising a valve controlling flow through the first inlet communicating the swimming pool with the vacuum filter.

25. A swimming pool according to claim 20, comprising a manifold and header line distribution system in the filter tank in fluid flow connection with the fluid flow connection communicating the tank with the swimming pool, and with the water recirculation system, respectively.

26. A swimming pool according to claim 25, comprising an apertured flow distributor in the tank extending across the tank beneath the inlet flow connections from the swimming pool and above the filter bed.

27. A swimming pool according to claim 25, comprising two valves in the filter tank, a first valve controlling flow into the tank from the first inlet to the filter bed, and the manifold and header line distribution system, and a second valve controlling water flow through the outlet to the water recirculation system.

28. A swimming pool according to claim 27, comprising means manually operating the valves between open and closed positions.

29. A swimming pool according to claim 27, comprising means automatically operating the valves between open and closed positions.

* * * * *